United States Patent [19]

Hunter et al.

[11] Patent Number: 4,848,970

[45] Date of Patent: Jul. 18, 1989

[54] MOORING APPARATUS AND METHOD OF INSTALLATION FOR DEEP WATER TENSION LEG PLATFORM

[75] Inventors: Andrew F. Hunter; James D. Bozeman, both of Houston, Tex.

[73] Assignee: Conoco Inc., Ponca City, Okla.

[21] Appl. No.: 232,396

[22] Filed: Aug. 11, 1988

Related U.S. Application Data

[63] Continuation-in-part of Ser. No. 105,941, Oct. 6, 1987, Pat. No. 4,784,529.

[51] Int. Cl.[4] ..... E02D 5/74

[52] U.S. Cl. ..... 405/224; 405/195; 405/227

[58] Field of Search ..... 405/224, 225, 227, 195, 405/203, 204; 114/264, 265; 175/5.7; 166/350, 359, 367; 138/177, 178, DIG. 11

[56] References Cited

U.S. PATENT DOCUMENTS

| | | | |
|---|---|---|---|
| 4,211,503 | 7/1980 | Peterson et al. | 405/216 |
| 4,226,555 | 10/1980 | Bourne et al. | 405/224 |
| 4,297,965 | 11/1981 | Horton et al. | 114/265 |
| 4,482,274 | 11/1984 | Brandi et al. | 405/224 |
| 4,491,439 | 1/1985 | Watkins | 405/145 X |
| 4,626,136 | 12/1986 | Gunderson | 405/224 |
| 4,634,314 | 1/1987 | Pierce | 405/195 |
| 4,664,554 | 5/1987 | Burns | 405/211 |
| 4,768,455 | 9/1988 | Maxson et al. | 114/264 |

OTHER PUBLICATIONS

Hamilton, J. and G. R. Perrett-"Deepwater Tension Leg Platform Designs", *Royal Inst. Naval Architects Develop In Deeper Water Int. Symp. Proc.* (London, Eng., Oct. 6-7, 1986); vol. 1 pap. No. 9, 1986.

*Primary Examiner*—Dennis L. Taylor
*Attorney, Agent, or Firm*—Richard K. Thomson

[57] ABSTRACT

A method for securely mooring a floating tension leg platform and an anchoring base template. The method involves swinging an end of a neutrally buoyant, one piece tendon which has an enlarged connector downwardly into position adjacent an anchoring receptacle, pulling the enlarged connector through a side-entry opening in the receptacle, lifting the tendon to seat the enlarged connector in a load ring of the receptacle, adjusting the effective length of the tendon to place it in tension and repeating these steps for each of the mooring tendons. A one-piece, thin-walled, neutrally buoyant tendon is also disclosed.

3 Claims, 6 Drawing Sheets

MOORING APPARATUS AND METHOD OF INSTALLATION FOR DEEP WATER TENSION LEG PLATFORM

This application is a continuation-in-part of U.S. patent application Ser. No. 07/105,941 filed Oct. 6, 1987, now U.S. Pat. No. 4,784,529.

This invention relates to the art of offshore structures and, more particularly, to a tension leg-moored floating structure for exploitation of hydrocarbon reserves located in deep water.

BACKGROUND OF THE INVENTION

With the gradual depletion of onshore and shallow subsea subterranean hydrocarbon reservoirs, the search for additional petroleum reserves is being extended into deeper and deeper waters on the outer continental shelves of the world. As such deeper reservoirs are discovered, increasingly complex and sophisticated production systems are being developed. It is projected that soon, offshore exploration and production facilities will be required for probing depths of 6,000 feet or more. Since bottom-founded structures are generally limited to water depths of no more than about 1500 feet because of the sheer size of the structure required, other, so-called compliant structures are being developed.

One type of compliant structure receiving considerable attention is a tension leg platform (TLP). A TLP comprises a semi-submersible-type floating platform anchored to piled foundations on the sea bed through substantially vertical members or mooring lines called tension legs. The tension legs are maintained in tension at all times by ensuring that the buoyancy of the TLP exceeds its operating weight under all environmental conditions. The TLP is compliantly restrained by this mooring system against lateral offset allowing limited surge, sway and yaw. Motions in the vertical direction of heave, pitch and roll and stiffly restrained by the tension legs.

Prior TLP designs have used heavy-walled, steel tubulars for the mooring elements. These mooring elements generally comprise a plurality of interconnected short lengths of heavy-walled tubing which are assembled section by section within the corner columns of the TLP and, thus lengthened, gradually extend through the depth of the water to a bottom-founded anchoring structure. These tension legs constitute a significant weight with respect to the floating platform, a weight which must be overcome by the buoyancy of the floating structure. As an example, the world's first, and to date only, commercial tension leg platform installed in the U.K. North Sea, utilizes a plurality of tubular joints thirty feet in length having a ten-inch outer diameter and a three inch longitudinal bore. The tension legs assembled from these joints have a weight in water of about two hundred pounds per foot. In the 485-foot depth of water in which this platform is installed, the large weight of sixteen such tendons must be overcome by the buoyancy of the floating structure. It should be readily apparent that, with increasingly long mooring elements being required for a tension leg platform in deeper water, a floating structure having the necessary buoyancy to overcome these extreme weights must ultimately be so large as to be uneconomic. Further, the handling equipment for installing and retrieving the long, heavy tension legs adds large amounts of weight, expense and complexity to the tension leg platform system. Flotation systems can be attached to the legs but their long-term reliability is questionable. Furthermore, added buoyancy causes an increase in the hydrodynamic forces on the leg structure.

In addition to the weight penalty, the cost and complexity of the handling and end-connection of such tension legs is also very high. For instance, in each corner column of the floating structure, complex lowering and tensioning equipment must be provided for assembling, and extending and retrieving each of the tension legs located in that corner.

Additionally, once the tension legs are properly in position, some type of flexible joint means must be provided to allow compliant lateral movement of the platform relative to the anchor. Typical of such a structure is a cross-load bearing such as described in U.S. Pat. No. 4,391,554.

Means must also be provided on the lower end of the tension legs for interconnecting with the foundation anchors. Most of the suggested anchor connectors are of the stab-in type such as described in U.S. Pat. Nos. 4,611,953; 4,459,993; and 4,439,055. These complex structures comprise a resilient flex bearing assembly as well as some type of mechanical latch structure activated by springs and/or hydraulic forces. Obviously, the complexity and expense, as well as the potential for failure, with such structures must be taken into consideration. Another type of tendon connector which has been proposed but never used is described in British Patent No. 1,604,358. In this patent, wirerope tendons include enlarged end portions which interconnect with the anchoring means in the manner of a side-entry chain and eye connection.

SUMMARY OF THE INVENTION

In accordance with the invention, a method of mooring an offshore platform in a body of water comprises locating a plurality of anchoring means on the floor of the body of water, the anchoring means being adapted for receipt of a mooring tendon through a side-entry opening in an anchoring means. A semi-submersible floating structure is stationed above the anchoring means, the floating structure including a plurality of tension receptacles adapted for side-entry receipt of a mooring tendon. The mooring tendons each comprise substantially rigid, one-piece mooring elements which are initially disposed substantially horizontally near the surface and adjacent to the floating structure, the tendons having enlarged top and bottom end connectors and a length which is greater than an initial distance from the tendon receptacles on the floating structure and those on the anchoring means. The enlarged bottom end connector of a tendon is swung downwardly into position adjacent one of the plurality of anchoring means and the enlarged bottom end of the tendon is then pulled through the side-entry opening. The tendon is then lifted to bring the enlarged bottom end connector into contact with a load ring in the bottom receptacle. The enlarged top end connector is also positioned in one of the side-entry tendon receptacles on the floating structure. The effective length of the tendon is then adjusted so that it is equal to or, preferably less than the initial distance, the process being repeated for each of the plurality of tendons and tendon receptacles until the offshore platform is moored in the body of water.

Further in accordance with the invention, the side-entry receptacles for the one-piece tendon incorporate a load-bearing ring which, in installed position, compressively engages the enlarged top and bottom end, connectors respectively, of the one piece tendon structure.

Further in accordance with the invention, the top tendon receptacles are located in an easily accessible position on the exterior surface of the corner columns of the floating structure.

Still further in accordance with the invention, the enlarged top and bottom end connectors of the one-piece tendon structure each incorporate a spherical flex bearing which allows for angular deviation of the installed tendons from the vertical position.

In yet another aspect of the invention the one-piece tendons are constructed by welding a plurality of tubular joints together to form a unitary tendon, the assembly of the one-piece tendons taking place at a location remote from the installation site, the one-piece tendons being transported through the water by a buoyant, off-bottom tow method, or surface tow method, depending on water depth and transportation route conditions.

In still another aspect of the invention, the side-entry receptacle on the subsea anchor has a frustoconical first portion with a side-entry opening having a height that is at least twice the height of the maximum height of the connector it receives to facilitate connection thereof.

Various features, characteristics and advantages of the present invention will become apparent after a reading of the detailed description which follows.

BRIEF DESCRIPTION OF THE DRAWINGS

The objects of the present invention are accomplished as described hereinafter in conjunction with the accompanying drawings forming a part of this specification and in which.

DETAILED DESCRIPTION OF THE PREFERRED EMBODIMENTS AND THE DRAWINGS

Figure 1:
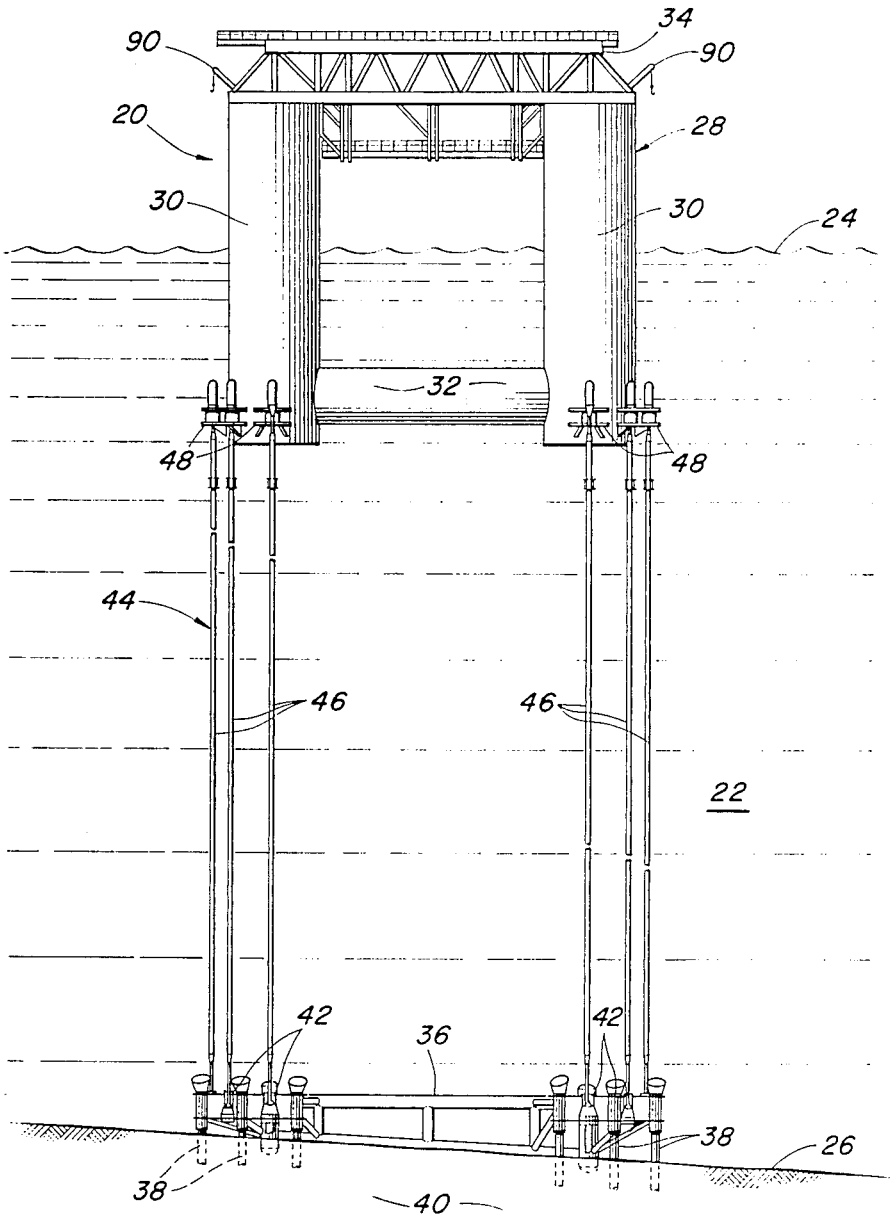
FIG. 1 is a side elevational view of a tension leg platform incorporating the features of the present invention.

Referring now to the drawings wherein the showings are for the purposes of illustrating preferred embodiments of the invention only and not for the purpose of limiting same, FIG. 1 shows a tension leg platform (TLP) 20 in accordance with the present invention. The TLP 20 is installed in a body of water 22 having a surface 24 and a floor 26. The TLP 20 comprises a semi-submersible structure 28 floating at the surface 24 of the body of water 22.

The floating structure 28 generally comprises a number of vertical cylindrical columns 30 which are interconnected below the surface 24 by a plurality of horizontally disposed pontoons 32. In the preferred structure shown in the drawings, the floating structure 28 comprises four cylindrical columns 30 interconnected by four equal-length pontoons 32 in a substantially square configuration when seen in plain view. It will be understood that other configurations are possible including variations of the shapes of the pontoons and the columns and that the number of columns may range from three to eight or more without departing from the general concept of a semi-submersible structure suitable for use as a tension leg platform.

A deck structure 34 is positioned on, and spans the tops of, the vertical cylindrical columns 30 and may comprise a plurality of deck levels as required for supporting the desired equipment such as hydrocarbon production well heads, riser handling equipment, drilling and/or workover equipment, crew accommodations, helipad and the like, according to the needs of the particular installation contemplated.

A foundation template 36 is located on the floor 26 of the body of water 22 and positioned by a plurality of anchor pilings 38 received in piling guides 39 and extending into the subsea terrain 40 below the sea floor 26. In accordance with the invention, the foundation template includes a plurality of side-entry tendon receptacles 42 located on the corners of the template 36 and positioned intermittently with pile guides 39. The template 36 may include additional features such as well slots for drilling and production of subsea hydrocarbons, integral subsea storage tanks and the like.

The semi-submersible floating structure 28 is moored over the foundation template 36 by a plurality of tension legs 44 extending from the corners of the floating structure 28 to the corners of the foundation template 36. Each of the tension legs 44 comprises a mooring tendon 6 which is attached at its upper end to a side-entry tendon tie-down or mooring porch 48 located on the exterior surface of the vertical cylindrical columns 30 of the floating structure 28 and connected at its lower end in one of the side-entry tendon receptacles 42 located on the foundation template 36.

Figure 9:
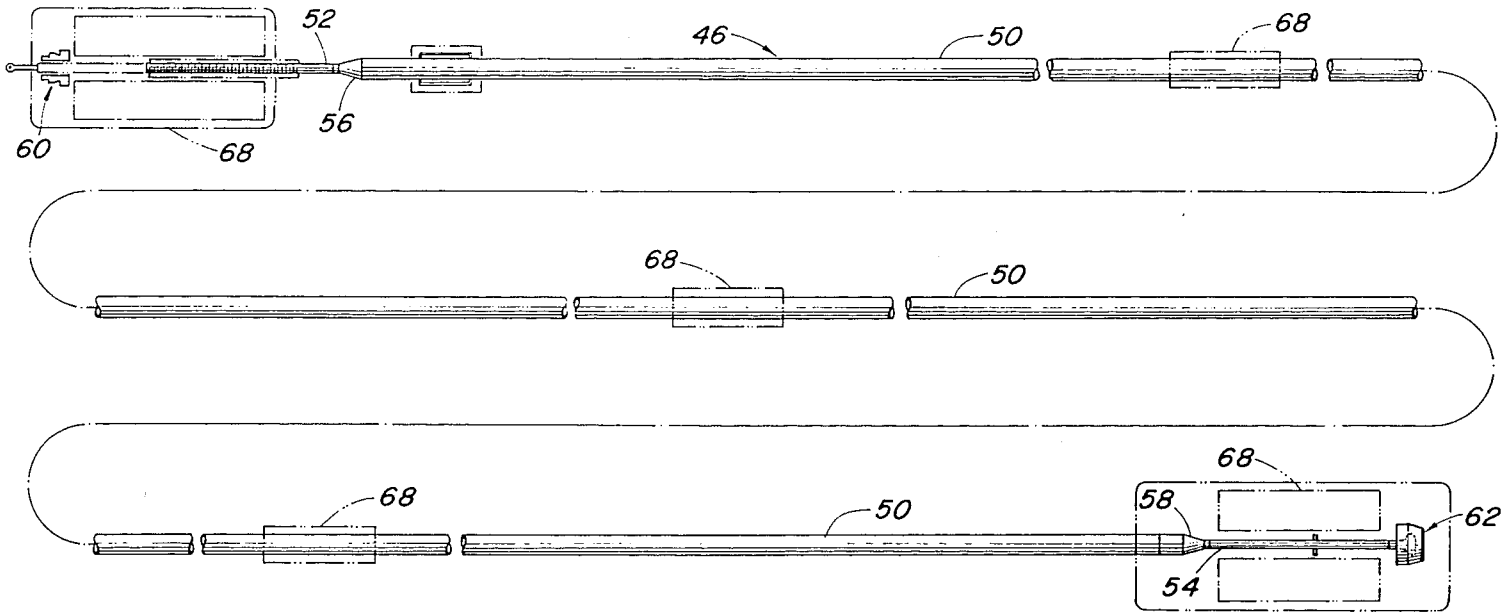
FIG. 9 is a schematic plan view of a mooring tendon showing its end connectors as they would appear during tendon tow-out.

The mooring tendons 46 comprise a one-piece, thin-walled tubular central section 50 (FIG. 9) with smaller diameter, thick-walled upper and lower tendon coupling sections 52, 54 respectively interconnected with the central section 50 by upper and lower tapered sections 56, 58, respectively. The upper tendon coupling section 52 includes an enlarged upper flex connector 60 which may be adjustably positioned along the length of the upper tendon coupling section 52 such as by screw threads or other adjustment means all of which will be more fully described hereinafter. In this manner, the effective length of tendon 46 can be adjusted. In a similar fashion, the lower tendon coupling section 54 includes an enlarged lower flex connector 62 in a fixed location at the lower end of the lower tendon coupling section 54 and will similarly be more fully described hereinafter.

The sequence shown in FIGS. 2A through 2F illustrates the installation of a single mooring tendon in accordance with the method of the present invention. It will be understood that, since a plurality of mooring tendons are required for tethering a tension leg platform, a plurality of mooring tendons are installed either simultaneously or sequentially. As one example, one tendon from each column 30 could be simultaneously installed.

In accordance with the invention, the foundation template 36 is pre-installed on the floor 26 of the body of water 22. Location of the foundation template may be by pilings driven into the sea floor terrain or the template 36 may comprise a so-called gravity base which maintains its location principally by means of its sheer size and weight. The template 36 may include one or more pre-drilled well slots which may be completed to tap subsea hydrocarbon formations and then capped off and shut in until connection with the floating TLP structure can be effected.

The semi-submersible floating structure 28 is positioned over the foundation template 36. The positioning may be by temporary catenary mooring of the floating structure 28 or, in order to avoid interference by the mooring catenaries in the installation procedure, the floating structure 28 is preferably maintained in position by the use of one or more separate vessels such as tugs and/or crane barges (not shown). It will be understood that the substantially fixed positioning of the floating structure 28 substantially directly vertically over the foundation template 36 is required for the installation procedure.

The mooring tendon 46 is pre-constructed as a unitary structure and may be towed to the installation site by a buoyant, off-bottom tow method employing leading and trailing tow vessels 64, 66, respectively. The construction method for the mooring tendons 46 is substantially similar to that described for the construction and transport of subsea flow lines described in U.S. Pat. No. 4,363,566 although, other similar methods may be employed. In this process, individual short lengths of tubing are welded together to form a unitary structure. Preferably, the entire length of the tendon is assembled and laid-out on shore prior to its launch as a unitary structure into the water for tow out to the installation site. As stated previously, the mooring tendon 46 is constructed as a thin-walled tubular member so as to be neutrally buoyant in water.

A generalized formula for neutrally buoyant tendons can be derived by the following method. Equating the weight of the tendon to the weight of water it displaced produces $$\rho_t \frac{\pi(D^2 - d^2)}{4} \cdot L = \rho_s \frac{\pi D2}{4} \cdot L$$

Where $\rho_t$=density of tendon material
$\rho_s$=density of sea water
L =length of tendon
D =outer tendon diameter
d =inner tendon diameter Solving for a density ratio, produces $$\frac{\rho_s}{\rho_t} = \frac{D^2 - d^2}{D^2}$$

but since, $d=D-2t$, where t=wall thickness $$\frac{\rho_s}{\rho_t} = \frac{D^2 - (D - 2t)^2}{D^2} = \frac{4\,Dt - 4t^2}{D^2}$$

Cross multiplication and rearranging of terms into a guadratic equation produces $$\left(\frac{\rho_s}{\rho_t}\right)D^2 - 4\,Dt + 4t^2 = 0$$

Dividing by $t^2$ and then multiplying by $\rho t/\rho s$ gives $$\left(\frac{D}{t}\right)^2 - 4\left(\frac{\rho_t}{\rho_s}\right)\left(\frac{D}{t}\right) + 4\frac{\rho_t}{\rho_s} = 0$$

The general solution for the quadratic equation $ax^2+bx+c=O$ is expressed as $$x = \frac{-b \pm \sqrt{b^2 - 4\,ac}}{2a}$$

Substituting in the solution equation produces $$\left(\frac{D}{t}\right) = \frac{4\left(\frac{\rho_t}{\rho_s}\right) \pm \sqrt{\left[4\frac{\rho_t}{\rho_s}\right]^2 - 16\frac{\rho_t}{\rho_s}}}{2}$$

which simplifies to $$\left(\frac{D}{t}\right) = 2\left(\frac{\rho_t}{\rho_s}\right) + 2\left(\frac{\rho_t}{\rho_s}\right)\sqrt{1 - \frac{\rho_s}{\rho_t}} = 2\frac{\rho_t}{\rho_s}\left(1 + \sqrt{1 - \frac{\rho_s}{\rho_t}}\right)$$

By computing test values, the positive value of the square root was shown to produce the real solution to the quadratic and, accordingly, the negative or imaginary solution was dropped.

Plugging in values of s=64 lb/ft$^3$ and
$\rho t$=490.75 lb/ft$^3$ for steel
$\rho t$=281 lb/ft$^3$ for titanium
$\rho t$=173 lb/ft$^3$ for aluminum
gives diameter to thickness ratio of 29.64 for a neutrally buoyant steel tendon, 16.52 for a titanium tendon and 9.69 for an aluminum tendon, for example.

For the purposes of towing, flotation means such as buoyancy tanks 68 (FIG. 2a and FIG. 9 in phantom) may be attached to the tendon 46 for the off-bottom tow method. Alternatively, a surface tow method might be utilized. When the towing vessels 64, 66 and the mooring tendon 46 reach the vicinity of the floating structure 28, the leading tow line 70 is passed to the floating structure. A second control line 72 (FIG. 2*b*) is also attached. A control vessel 74, which may or may not be the leading tow vessel 64, (FIG. 2*c*) is utilized to hold the upper tendon coupling section away from contact with the floating structure 28 through a third control line 76 which, in coordination with the second control line 72 and the lead tow line 70 act to control the positioning of the upper portion of the mooring tendon 46 adjacent the floating structure 28.

Figure 2A:
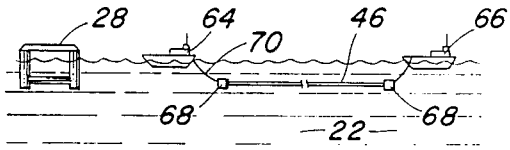
FIGS. 2A through 2F are schematic drawings showing the method of stepwise installation of one of the mooring tendons on the TLP of this invention.
Figure 2B:
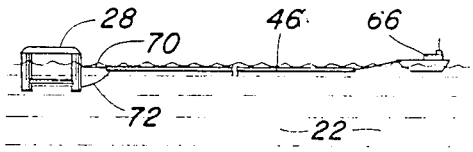
Figure 2C:
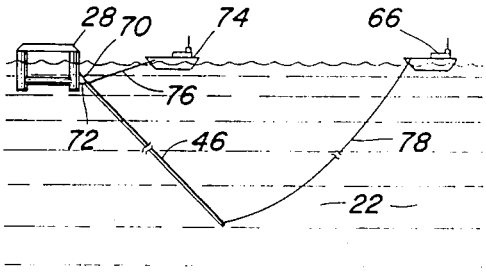
Figure 2D:
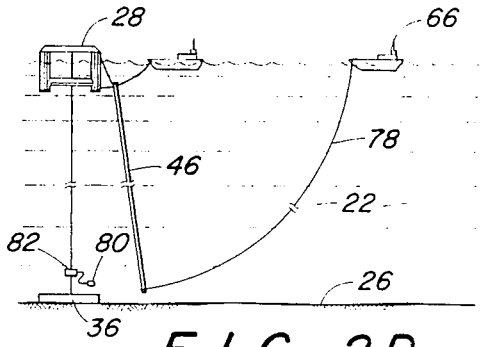
Figure 2E:
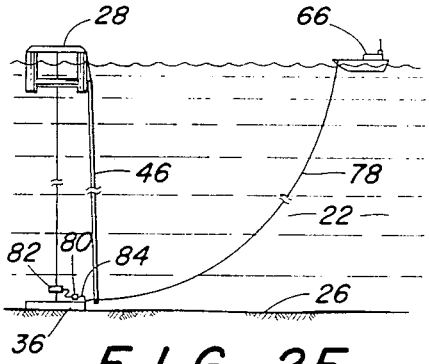
Figure 2F:
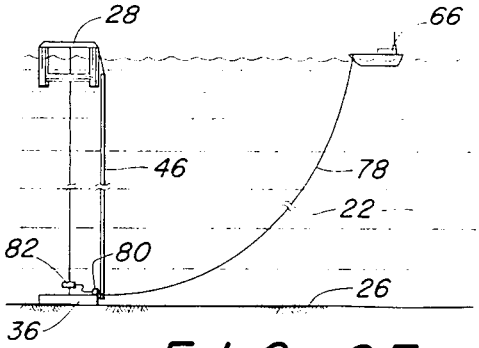
Figure 7C:
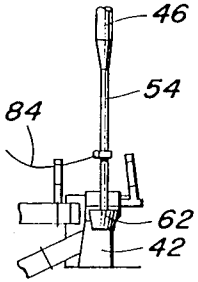
FIGS. 7A through 7C are stepwise schematic illustrations of the tendon bottom connector capture and receipt procedure in the installation of the mooring tendons in accordance with the present invention.
Figure 7B:
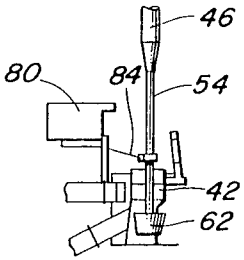
Figure 7A:
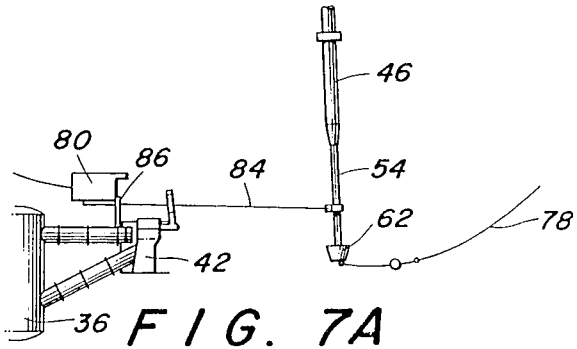

The trailing tow vessel 66 connects a lower control line 78 to the lower tendon coupling section of the mooring tendon 46 and begins to pay out the lower control line 78 allowing the mooring tendon 46 to swing downwardly toward the foundation template 36 (FIGS. 2*c* and 2*d*). When the mooring tendon 46 is in a near-vertical position, a remote operated vessel (ROV) 80 and its associated control unit 82 are lowered to a point near the foundation template 36. The ROV 80 attaches a pull-in line 84 to the lower end of the mooring tendon 46 on the lower tendon coupling section 54. As an alternative, a diver (not shown) might be utilized to attach the pull in line 84 for applications in more shallow water or the line may be connected before the tendon is swung down. The ROV 80 braces against pull-in guides 86 located adjacent and above the side entry tendon receptacles 42 on the foundation template 36 (FIGS. 7*a* through *c*). In drawing the lower tendon coupling section 54 into the side entry tendon receptacle 42, the ROV 80 and the pull-in line 84 act against a restraining force applied on the lower control line 78 to control the entry of the enlarged lower flex connector 62 so that damage to the connector 62 and the receptacle 42 is avoided.

Figure 3:
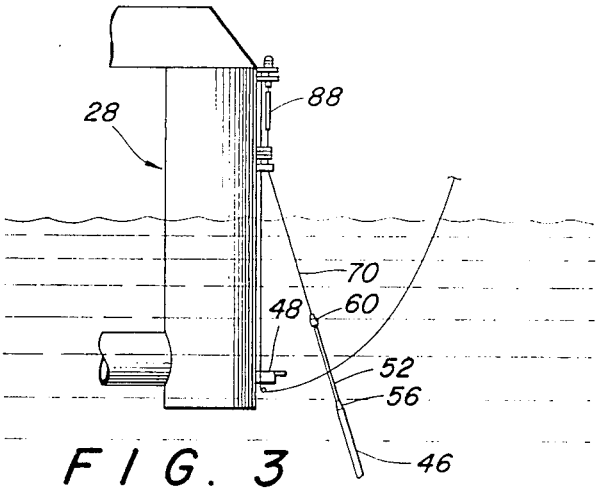
FIG. 3 is a schematic view of an intermediate step in the installation of the top of the tendon during the installation process shown in FIGS. 2A through 2F.

Once the enlarged lower flex connector 62 has been received within the side-entry tendon receptacle 42 (FIG. 7B), the tendon is hoisted to bring enlarged lower flex connector 62 into engagement with load ring 120 of receptacle 42 (FIGS. 7*c* and 8) and a tension force is applied on the upper tendon coupling section 52 through the lead tow line 70 by a tensioning device such as an hydraulic tensioner 88 (FIG. 3), a davit 90 located at the top of each of the cylindrical columns 30 (Fig. or any similar device. Once initial tension has been applied to the mooring tendon 46 and the enlarged lower flex connector 62 is in load-bearing engagement with the side-entry tendon receptacle 42, the pull-in line 84 and the lower control line 78 can be released or severed by the ROV 80.

Figure 4:
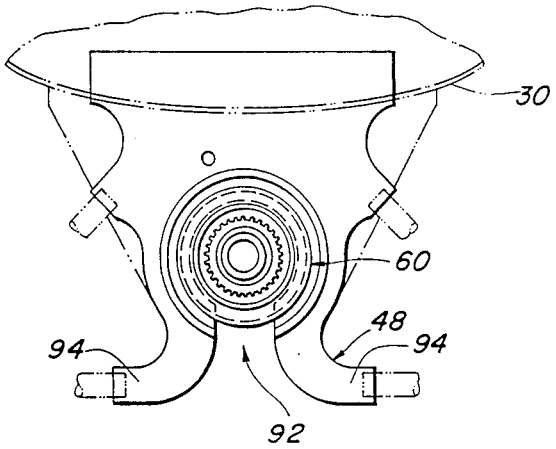
FIG. 4 is a top, plan view of one of the top tendon receptacles with a tendon in place in accordance with this invention.
Figure 5:
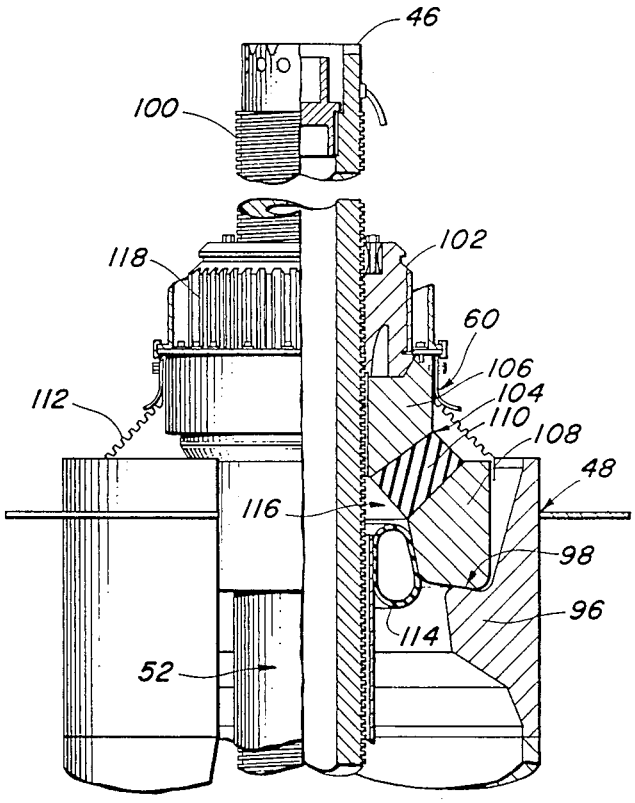
FIG. 5 is a side elevational view, in partial section, of the top tendon connector and side-entry receptacle shown in FIG. 4.

Following tensioning of the tendon, the enlarged upper flex connector 60 is brought into engagement with the side-entry tendon mooring porch 48. As best shown in FIGS. 4 and 5, the side-entry tendon mooring porch 48 includes a side-entry opening 92 and entry guides 94. The mooring porch 48 also includes a load ring 96 having an upwardly facing bearing surface 98 which is sloped upwardly from its outermost to innermost extent.

In accordance with the invention, the upper tendon coupling section 52 incorporates a threaded outer surface 100 to permit length adjustment of the tendon 46. The enlarged upper flex connector 60 includes an adjustment nut 102 having threads which engage the threaded outer surface 100 of the mooring tendon 46. The nut is turned along the threaded coupling section 52 until the effective length of the mooring tendon 46 is somewhat less than the true vertical distance between the floating structure and the anchoring means so that the tendon 46 is in tension. The tensile force on the mooring tendon 46 can thus be adjusted by turning the tendon nut 102 along the threaded outer surface 100 of the upper tendon coupling section 52 to vary the tension loading on the mooring tendon 46. As shown in FIG. 5, the tendon nut 102 includes an outer surface comprising gear teeth 118 which may be engaged by a gear drive mechanism (not shown) to turn the nut 102 to increase or decrease tendon tension as required. The adjustment nut 102 compressively bears against a flex bearing assembly 104 comprising a face flange 106, an upper connector shroud 108 and an intermediate flex bearing 110. When fully assembled in operating position, the tendon nut 102 bears on the top surface of the face flange 106 and tendon tension loadings are transferred through the flex bearing 110 and the upper connector shroud 108 which is in compressive bearing engagement with the bearing surface 98 of the load ring 96. The flex bearing 110 generally comprises a typical spherical flex bearing which is common in mooring tendon coupling sections, the flex bearing allowing some angular deviation of the mooring tendon 46 from a strict vertical position thereby allowing compliant lateral movement of the TLP structure.

In the preferred embodiment shown in FIG. 5, a flexible skirt 112 extending between the face flange 106 and the tendon mooring porch 48 and an inflatable water-tight seal 114 extending between the upper connector shroud 108 and the upper tendon coupling section 52 enclose the flex bearing assembly 104 within a water-tight chamber 116 which can be filled with a non-corrosive fluid to protect the flex bearing assembly 104.

It can be seen that with the combination of the external tendon mooring porch 48, the adjustable length feature of the upper tendon coupling section 52 and the combined adjustment nut 102 and flex bearing assembly 104, that ease of tendon installation (and removal for replacement) is greatly increased over the assembly of a number of joints which is common in the prior art. Furthermore, the above listed combination eliminates the need for much more complicated and costly cross-loadbearing systems which have been common in the past in order to accommodate angular deviation of a mooring tendon from the vertical due to lateral offset of the floating structure from a position directly above its anchor.

Figure 8:
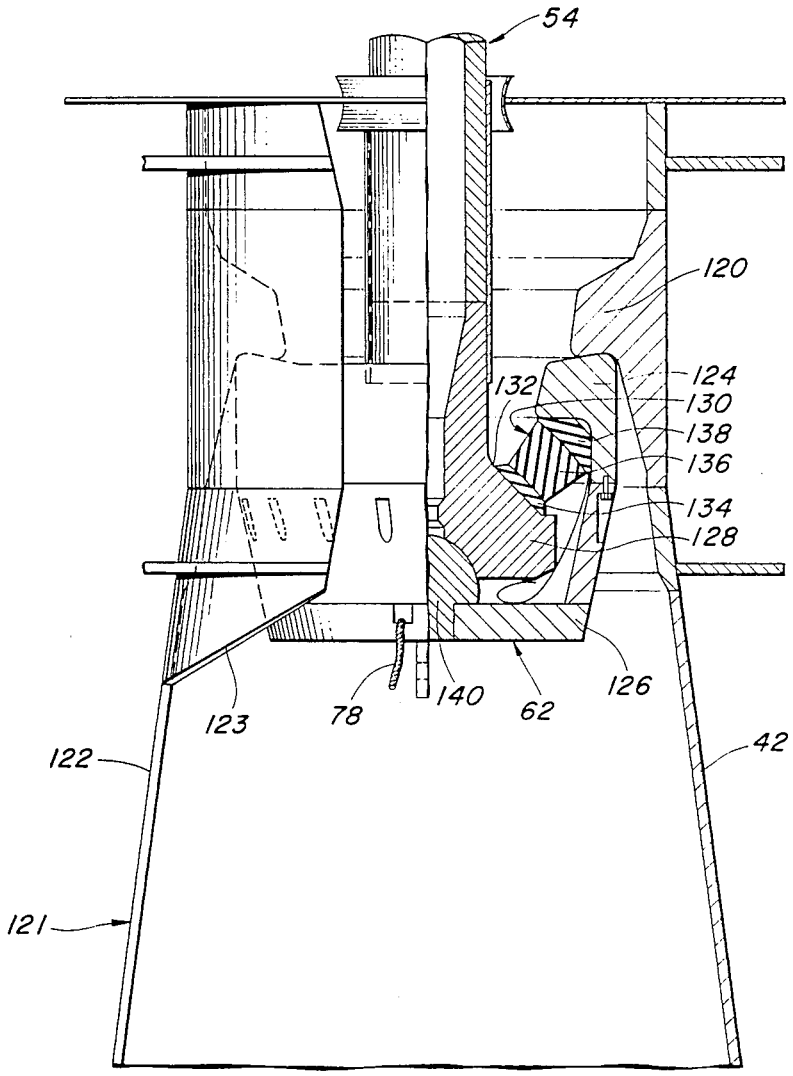
FIG. 8 is a side elevational view, in partial section, showing one of the bottom tendon receivers with the enlarged bottom end of a tendon in installed position.

As best shown in FIG. 8, the enlarged lower flex connector 62 of the lower tendon coupling section 54 engages the side-entry receptacle 42 on a lower load ring 120 which substantially corresponds to the load ring 96 of the side-entry tendon mooring porch 48. Side-entry receptacle 42 has a lower frustoconical portion 121 with tapered sides to facilitate insertion of enlarged flex connector 62 into the side-entry receiver 42. Side-entry opening 122 extends laterally at least $\frac{1}{3}$ the circumference of lower portion 21 and lengthwise at least twice the maximum dimension of lower flex connector 62. A slanting surface 123 extends between an upper portion of opening 122 and a lower portion of a narrow slot which receives tendon section 54. Surface 123 engages lower tendon section 54 and helps to center it within receptacle 42. The lower load-receiving surface of load ring 120 slopes downwardly from its outermost to its innermost extent. A supplementary surface atop lower back flange 124 mates with the similarly configured surface of load ring 120. The slope on these mating surfaces serves not only to help center connector 62 in receptacle 42 thereby distributing the load but, also, helps close the top and bottom side-entry openings. A reverse slope from that shown would tend to force the load rings 96 and 120 open permitting the upper or lower connector 60 or 62, respectively, to escape. This outward undercut, on the other hand, effectively improves the hoop strength of the load rings 96 and 120 by pulling inwardly a greater amount as the tendon tension increases.

Figure 6:
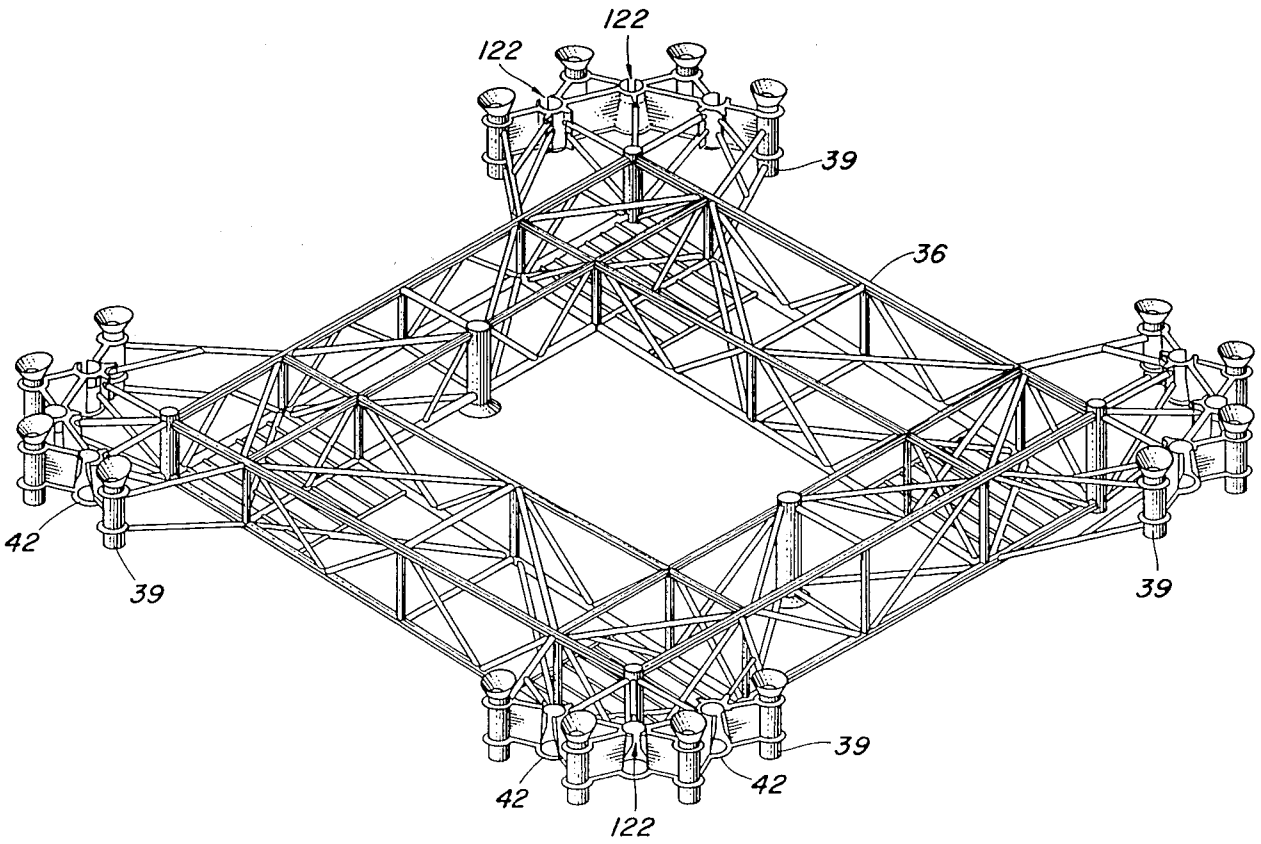
FIG. 6 is an isometric view of a foundation template incorporating the tendon anchor receptacles in accordance with the present invention.

Once the enlarged lower flex connector 62 has passed through the side-entry opening 122 and tendon section 54 through the narrow slot (FIGS. 6 and 8) and tension loading on the mooring tendon has drawn the enlarged lower flex connector 62 upwardly within the tendon receptacle 42, the load ring 120 is compressively engaged by a lower back flange 124 which is located on the upper portions of a bottom connector shroud 126 of the enlarged lower flex connector 62. The shroud 126 encloses the lower end 128 of the mooring tendon 46 and the lower flex bearing assembly 130 in a cup-like manner. In the preferred embodiment shown in the drawings, the lower end 128 of the mooring tendon 46 has a frustoconical form having a conical upper surface 132 which engages an inner bearing 134 of the flex bearing assembly. The inner bearing ring 134 is attached to a annular (preferably spherical) flex bearing 136 for translating compressive loadings outwardly to an outer bearing ring 138 which is in engagement with the back flange 124. In a manner similar to that of the upper flex connector 60, the flex bearing assembly 130 permits angular deviation of the mooring tendon 46 away from a strictly vertical position. In order to limit the angular deviation, the shroud 126 incorporates a centralizer plug 140 in its base surface. The centralizer plug 140 engages a spherical recess in the lower end 128 of the mooring tendon.

It can be seen that the combination of the enlarged lower flex connector 62 and the side-entry tendon receptacle 42 is a much simpler, cheaper and effective means for securing the lower end of a mooring tendon 46 when compared to the stab-in, latched mooring connectors of the prior art.

By way of example and not limitation, tendon 46 may be made of steel and may have an outside diameter of 30″ with a 1″ wall thickness. Upper and lower tendon coupling sections 52, and 54 may have an OD of about 15″ with a wall thickness of 2½″. Lower section 54 may be provided with a thin neoprene sleeve to protect it from damage during installation. The bottom end connector 62 may have a maximum width of 3′9″ and maximum height of 2′9″. Additional buoyancy may be achieved by use of external buoyancy tanks or collars (not shown) in order to obtain the desired neutrally buoyant tendon. Alternatively, the central portion of tendon 46 may be of sufficiently larger diameter to provide additional buoyancy to offset the weight of coupling sections 52 and 54. The wall thickness of tendon 46 will, of course, be sufficient to prevent collapse from the water pressure at the maximum depth of utilization and the tendon will be sealed against water entry (i.e., air tight).

While the invention has been described in the more limited aspects of a preferred embodiment thereof, other embodiments have been suggested and still others will occur to those skilled in the art upon reading and understanding of the foregoing specification. It is intended that all such embodiments be included within the scope of this invention as limited only by the appended claims.

Having best described our invention, we claim:

1. A one-piece prefabricated tendon for mooring a tension leg platform to the ocean floor in water depths of up to 3000 feet, said tendon comprising:

an upper tubular coupling section having a first relatively large wall thickness and a first relatively small outer tubular diameter;

a central tubular section which extends over a substantial majority of the length of said tendon, said central tubular section having a second relatively thin wall thickness and a second relatively large outer tubular diameter, said second relatively thin wall section having sufficient strength to withstand both tendon tension loads and compressive forces imposed by said ocean;

a lower tubular coupling section having a third relatively large wall, thickness and a third relatively small outer tubular diameter; each of said upper, central and lower tubular sections being comprised of a plurality of segments that are welded into a unitary tendon;

buoyancy means integrated into said one-piece tendon such that said tendon is, at least, substantially neutrally buoyant.

2. The one-piece prefabricated tendon of claim 1 wherein said buoyancy means is comprised of said tubular sections which are sealed water tight to maintain an amount of air trapped internally thereby providing a necessary minimum amount of buoyancy.

3. The one-piece prefabricated tendon of claim 1 wherein said second relatively thin wall thickness is designated 't' and said second relatively large tubular diameter is designated 'D' wherein said thickness t and diameter D substantially satisfy the relationship $$\frac{D}{t} = 2\left(\frac{\rho_t}{\rho_s}\right)\left(1 + \sqrt{1 - \frac{\rho_s}{\rho_t}}\right)$$

where $\rho t$=density of material from which said tendon is made and $\rho s$=density of sea water surrounding said tendon.

* * * * *